US008550382B2

(12) United States Patent
Heatley et al.

(10) Patent No.: US 8,550,382 B2
(45) Date of Patent: Oct. 8, 2013

(54) INSERT FOR INVERTED SPRAY NOZZLE

(75) Inventors: Christopher Heatley, McHenry, IL (US); William G. Zanellato, Sycamore, IL (US); Jon Larson, Sycamore, IL (US)

(73) Assignee: Seymour of Sycamore Inc., Sycamore, IL (US)

( * ) Notice: Subject to any disclaimer, the term of this patent is extended or adjusted under 35 U.S.C. 154(b) by 1119 days.

(21) Appl. No.: 12/082,921

(22) Filed: Apr. 15, 2008

(65) Prior Publication Data

US 2009/0256011 A1 Oct. 15, 2009

(51) Int. Cl.
*B05B 1/00* (2006.01)

(52) U.S. Cl.
USPC ..... 239/600; 239/592; 239/303

(58) Field of Classification Search
USPC ..... 239/589, 592–594, 597, 600, 302, 239/390, 289
See application file for complete search history.

(56) References Cited

U.S. PATENT DOCUMENTS

| | | | | |
|---|---|---|---|---|
| 4,728,007 | A | | 3/1988 | Samuelson et al. |
| 5,040,701 | A | * | 8/1991 | Knickerbocker et al. ..... 222/153.07 |
| 5,249,747 | A | * | 10/1993 | Hanson et al. ..... 239/373 |
| 5,823,405 | A | | 10/1998 | Benns |
| 5,890,661 | A | * | 4/1999 | Crampton et al. ..... 239/544 |
| 5,934,518 | A | * | 8/1999 | Stern et al. ..... 222/402.1 |
| 6,021,961 | A | * | 2/2000 | Brown ..... 239/398 |
| 6,325,256 | B1 | | 12/2001 | Liljeqvist et al. |
| 6,783,037 | B1 | | 8/2004 | Bonham |
| 7,137,536 | B2 | | 11/2006 | Walters et al. |

FOREIGN PATENT DOCUMENTS

| | | |
|---|---|---|
| EP | 1908704 A1 | 9/2008 |
| JP | 06-001382 | 1/1994 |

OTHER PUBLICATIONS

International Search Report for PCT/US2009/040366 completed on Jul. 15, 2009 and mailed on Jul. 23, 2009.

* cited by examiner

*Primary Examiner* — Davis Hwu
(74) *Attorney, Agent, or Firm* — McDonnell Boehnen Hulbert & Berghoff LLP

(57) ABSTRACT

A device for modifying the spray pattern of an inverted spray nozzle to allow a user to mark an object with precise and clear writing of letters or symbols. The device is an insert that removably fits into or over an existing invert spray nozzle.

14 Claims, 2 Drawing Sheets

INSERT FOR INVERTED SPRAY NOZZLE

BACKGROUND OF THE INVENTION

Our invention relates to a device to allow users of inverted aerosol canisters containing paint or other marking substance to spray precise pin point markings, such as letters or symbols, on objects, such as roadways, buildings, walkways, etc. to assist construction or utility repair crews and the like. The device is an insert that can be removably press fit into the outlet of an inverted spray nozzle that is normally attached to an aerosol container.

Specifically our invention is directed to dispensing devices for discharging an aerosol product in a generally downward direction. Such aerosol dispensing devices are well known and comprise an aerosol valve located internal in an aerosol container. The aerosol valve is biased into a closed position. A valve stem cooperates with the aerosol valve for opening the aerosol valve. An actuator engages with the valve stem to open the aerosol valve for dispensing an aerosol product from the aerosol container. The aerosol product is dispensed from the aerosol valve through a spray nozzle. Various types of actuators have been utilized by the prior art for actuating an aerosol dispensing device. The first and the most basic type of actuator for an aerosol dispensing device is an actuator button that is affixed to the valve stem. A depression of the actuator button depresses the valve stem to open the aerosol valve for dispensing the aerosol product from the aerosol container. A protective cap is utilized for engaging with a rim of the aerosol container for inhibiting accidental actuating of the aerosol button.

The second type of actuator for an aerosol dispensing device is an aerosol overcap. The aerosol overcap replaces the conventional protective cap and includes an actuator for actuating the aerosol valve of the aerosol dispensing device. The aerosol overcap comprises a base engagable with the rim of the aerosol container for mounting the overcap to the aerosol container. The aerosol over cap includes an actuator pivotably mounted to the overcap base and engaging with the valve stem. The movement of the actuator of the aerosol overcap causes a depression of the valve stem to open the aerosol valve for dispensing the aerosol product from the aerosol container.

A third type of actuator for actuating an aerosol dispensing device is a trigger device. In this third type of actuators, a base is mounted either to the container rim or the mounting cup rim for supporting a trigger. The trigger is engagable with the valve stem. A movement of the trigger from an extended position to a protracted position depresses the valve stem to open the aerosol valve for dispensing the aerosol product from the aerosol container.

Our invention is directed to inverted aerosol containers that are designed to be used in an inverted position as compared to the tradition aerosol products where the spray nozzle and aerosol valve is on the top of the aerosol container for dispensing the aerosol products through the spray nozzle in an upright position. Existing spray nozzles on these known inverted aerosol containers are not designed to spray precise crisp lines to write letters and/or symbols that can be clearly read when sprayed on an object. Over spraying with these existing nozzles leads to blurred and unclear lettering. As such, a need exists to provide clear, precise and pin point lettering when writing with an inverted aerosol product containing paint or other marking or coating composition.

Our invention solves the problems of existing inverted spray marking products by providing a small insert that fits in or around an existing spray nozzle exit orifice and that can be removed and stored for repeated use when the need arises to mark an object with clear and precise writing.

SUMMARY OF THE INVENTION

Our invention is an insert for an inverted aerosol spray nozzle that narrows a stream of paint or other marking substance contained in a pressurized container to allow a user to mark objects with precise letters or symbols, the insert comprises a conical shaped housing of fixed length defining a hollow passage and having an inlet end and an outlet end both in fluid communication with the hollow passage, where the inlet end is sized to achieve a removable connection, preferably a press fit, with the spray nozzle and has a larger opening than the outlet end, and where the outlet end is in open communication with the ambient surroundings. Our spray nozzle insert changes the spray pattern and spray rate compared to that of a conventional inverted nozzle alone. The insert reduces the spray rate and the narrows the spray pattern.

The advantages of our invention include the ability to precisely write letters or symbols with atomized paint or other marking substance delivered by a pressurized aerosol container. The insert of our invention is also removable and reusable so that the aerosol product can be used in its traditional fan or wide spray when the need to mark with fine or precise lines is not required. Additionally, our invention provides for an insert holder for the insert when not connected to the inverted spray nozzle. This holder is most preferably located in, or integral with, the protective cap that removably snaps onto the container to protect the valve and spray nozzle combination.

Still further advantages of the present invention will become apparent upon reading and understanding the following detailed description of preferred embodiments. The invention also may take form in various materials of construction and arrangement of parts. The accompanying drawings are only for purposes of illustrating preferred embodiments and are not to be construed as limiting the invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENT

Figure 1:
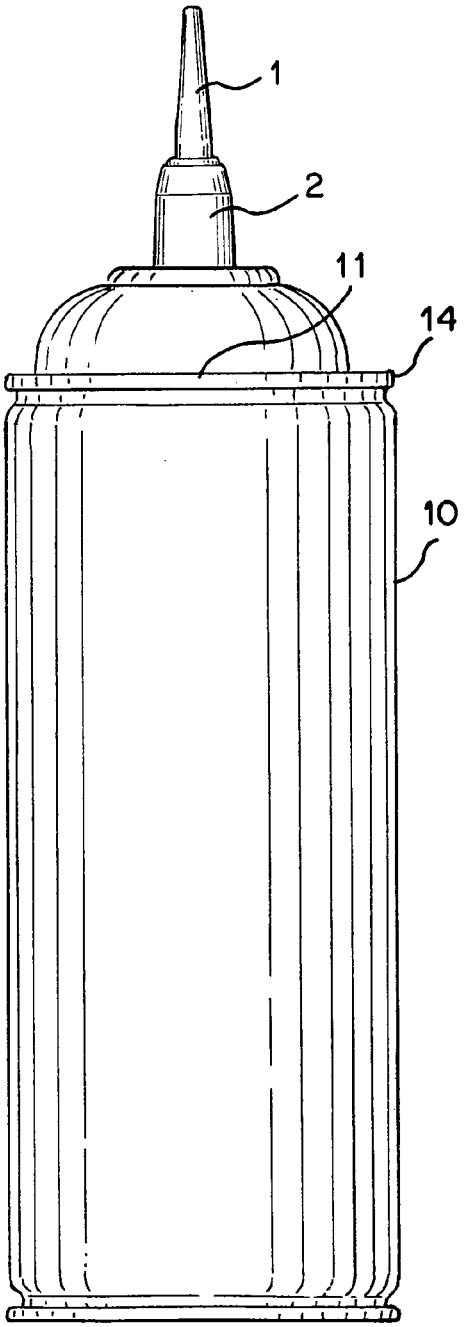
FIG. 1 is cross-section of an aerosol container for inverted spraying of a marking substance showing one embodiment of the insert of our invention attached to the inverted spray nozzle.
Figure 2:
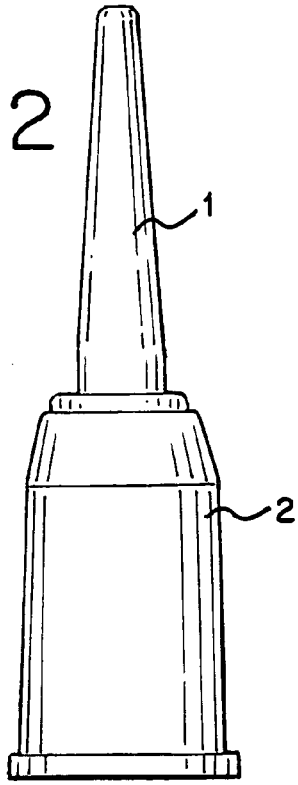
FIG. 2 is a side view of one embodiment of the insert of our invention attached to the inverted spray nozzle.
Figure 3:
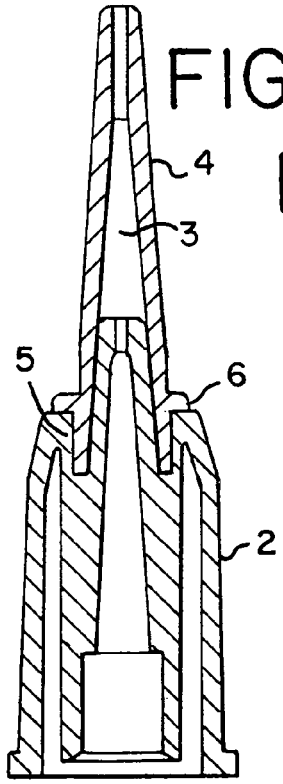
FIG. 3 is a FIG. 1 is cross-section of one embodiment of the insert of our invention attached to the inverted spray nozzle.

Referring now to FIG. 1, which shows an aerosol container 10 designed to be held by a user in an inverted position for spraying paint or other marking substances onto horizontal objects, typically at ground level. Such inverted pressurized spray containers are used to mark objects such as roadways, walkways, yards, buildings or other structures for construction, survey, safety, or the like purposes. These containers are characterized in that they have very short dip tubes 11, or with no dip tube at all, and discharge the paint or other marking substance through an inverted spray nozzle 2. Our invention provides for an insert 1 that is releasably connected to the inverted spray nozzle as depicted in FIGS. 1-3. Any connection type known to the art can be used on the inlet end 7 of the insert provided that the insert can be disconnected and reconnected without damaging the inert or the inverted spray valve. Preferred connections would include a screw fitting, snap-lock, press fit, luer-lock, bayonet, quick disconnect, or any other known releasably connector. For ease and speed of connection the most preferred connector is a press fit connection.

Figure 4:
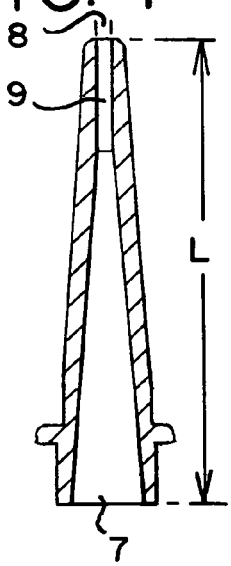
FIG. 4 is cross-sectional line drawing of one embodiment of the insert of our invention.

The insert can be manufactured as a single piece of material or as a composite of several parts made of the same or different materials of construction. In either case, the materials of construction can include a variety of materials, including, but not limited to plastic, metal, glass, phenolic, ceramic, and wood. These materials can be molded, machined, or casted. The insert has a housing 4, preferably conical in shape, which defines a hollow portion 3. Although the shape of this internal passage of the insert is not critical to our invention, it is preferred that the hollow portion is generally conical, as depicted in FIG. 3, and may terminate in a uniform cylindrical passage 9 as best seen in FIG. 4. This passage 9 is preferably uniform in dimension and has a generally circular shape and terminates in an opening or outlet end 8. Opposite outlet end 8 is inlet end 7, which has a larger opening than outlet end 8. As with outlet end 8, it is preferred to have inlet end 7 have a circular opening, however, any shaped inlet or outlet could be used.

Figure 5:
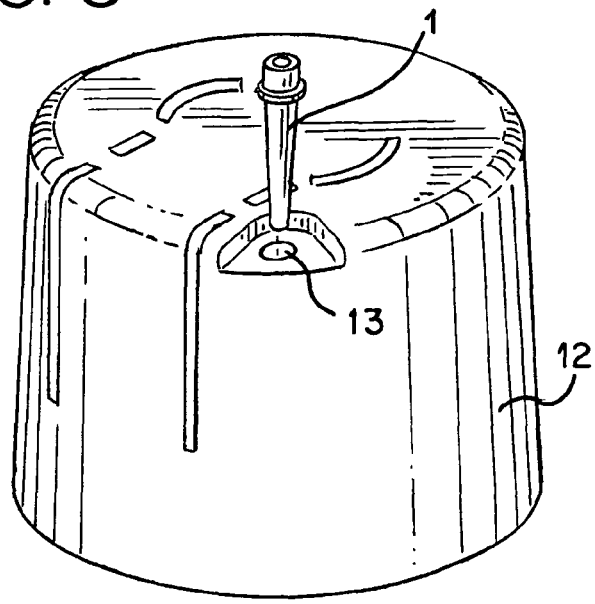
FIG. 5 is a perspective view of one embodiment of the combination of the insert and insert holder located in an aerosol container cap for storing the insert when not connected to the inverted spray nozzle.

As stated, inlet end 7 is generally circular in shape and designed such that it can releasably connect with outlet 5 of inverted spray nozzle 2. This connection may be a male/female connection as depicted in FIG. 3 or a female/male connection where the inlet end 7 of the insert fits over (as opposed to into) the inverted spray nozzle. Our insert may also contain a stop or bearing surface feature projecting outwardly from the housing. The exact shape and design of the stop is not critical to our invention, however, the flange design shown as item 6 in FIG. 3 is a preferred form of the stop. When a stop is included as part of the insert, its primary purpose is related to a further feature of our invention. That feature relates to a combination insert holder and cap function. One embodiment of this concept is shown in FIG. 5, where cap 12 includes insert holder 13 to store the insert (and prevent loss or misplacement of the insert) when not in use. In this connection the stop or flange 6 will prevent insert 1 from being push too far into holder 13. Flange 6 also proves a surface to grip when removing inert 1 from cap 13 for connection with inverted spray nozzle 2.

The length "L" of the nozzle and the size of outlet 8 are selected to maximize the atomization of the paint or other marking substance contained in pressurized container 10 in order to obtain the most precise and pinpoint writing of letters or symbols when directed on an object to be marked. The preciseness of the writing ability of our insert was tested using our standard inverted tip marking paint with an actuator that had a 0.040" exit orifice. Attached to this actuator, was an extension tip that was ¾" in length with a 0.010" exit orifice. Testing was done spraying the can at a distance of 2" from the substrate with the goal of obtaining the line that was ½" in width or less. A preferred ratio of length "L" to outlet end diameter is in the range from about 350 to about 1.

Figure 6:
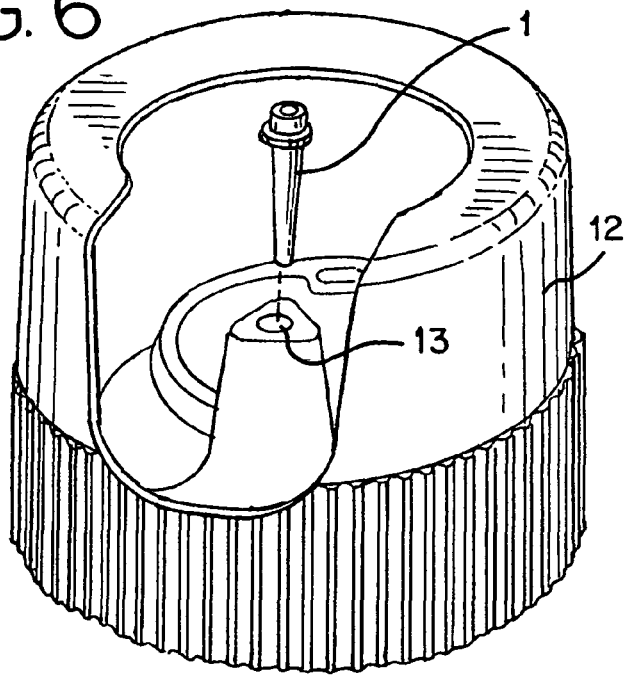
FIG. 6 is a perspective view of another embodiment of the insert holder of our invention in an aerosol container cap for storing the insert when not connected to the inverted spray nozzle.

As mentioned, another aspect of our invention is to provide an insert holder because the insert is designed to be releasably connected to the inverted spray nozzle and therefore it needs to be stored when not in use. This is accomplished most easily by providing a holder for the insert that is built into the cap that attached to the rim 14 of container 10 covering inverted spray valve 2. FIGS. 5 and 6 show two possible embodiments of inert holder 13 of our invention, however, any holder configuration may be used provided that the insert is held securely and is easily removed when it is needed for connection to the spray nozzle.

The invention has been described with reference to a preferred embodiment. Obviously, modifications and alterations will occur to others upon reading and understanding the preceding specification. It is intended that the invention be construed as including all such alterations and modifications insofar as they come within the scope of the appended claims or the equivalents thereof.

We claim:

1. A combination of an aerosol container cap and insert for removable connection to a single inverted spray nozzle fixed to the aerosol container, where the insert comprises a housing of fixed length defining a conical hollow passage and having an inlet end and an outlet end both in fluid communication with the hollow passage, where the inlet end has a single connector that removably fits with the single inverted spray nozzle that is directly attached to an aerosol container of spray paint and has a larger opening compared to a single opening in the outlet end, where the insert narrows a stream of paint or other marking substance to allow a user to mark objects with precise pin point letters or symbols, and where the cap is configured to attach to the container covering the single inverted nozzle and has a holder accessible on an outside surface of the cap configured to removably secure and hold the insert when the insert is not connected to the spray nozzle.

2. The insert of claim 1 wherein the housing is conical shaped.

3. The insert of claim 1 wherein the releasable connector is a removable press fit design that forms a liquid seal with a single orifice in the inverted spray nozzle attached to the aerosol container of spray paint.

4. The insert of claim 1 wherein the inverted spray nozzle has a single inlet orifice and the inlet end of the insert is male shaped and is configured to be removably connected into the single orifice of the inverted spray nozzle.

5. The insert of claim 3 wherein the inlet end of the insert is female and is configured to be removably connected over the single orifice of the inverted spray nozzle.

6. The insert of claim 4 where the housing has a bearing surface that limits insertion of the insert into the inverted nozzle orifice.

7. The insert of claim 6 where the bearing surface is a flange.

8. The insert of claim 1 where the ratio of the length of the housing to the outlet end opening is selected to provide the maximum atomization of paint or other marking substance.

9. The insert of claim 1 where the opening of the outlet is circular.

10. The insert of claim 1 where the hollow passage of the housing is conical at the inlet end and terminates to a uniform circular portion at the outlet end.

11. The insert of claim 1 wherein the insert is composed of a material selected from the group consisting of plastic, metal, glass, phenolic, ceramic, and wood.

12. The insert of claim 1 where the housing is a unitary molded part.

13. The insert of claim 1 where the housing has a bearing surface that provides a travel stop when the insert is placed into the holder.

14. The insert of claim 13 where the bearing surface is a flange.

* * * * *